US007588277B2

(12) United States Patent
Crown

(10) Patent No.: US 7,588,277 B2
(45) Date of Patent: Sep. 15, 2009

(54) CAULK CADDY

(76) Inventor: Thomas Crown, 946 NW. 64th St., Seattle, WA (US) 98107

( * ) Notice: Subject to any disclaimer, the term of this patent is extended or adjusted under 35 U.S.C. 154(b) by 0 days.

(21) Appl. No.: 11/842,846

(22) Filed: Aug. 21, 2007

(65) Prior Publication Data

US 2008/0088144 A1 Apr. 17, 2008

Related U.S. Application Data

(60) Provisional application No. 60/851,268, filed on Oct. 13, 2006.

(51) Int. Cl.
*A45F 5/00* (2006.01)
*B65D 85/00* (2006.01)

(52) U.S. Cl. ..... 294/146; 294/141; 206/384

(58) Field of Classification Search ..... 294/141, 294/146; 206/201, 203, 384; D3/309; D9/753; 211/70.6

See application file for complete search history.

(56) References Cited

U.S. PATENT DOCUMENTS 2,552,361 A * 5/1951 Acton ..... 206/201
D195,702 S * 7/1963 Russon ..... D3/309
3,297,196 A * 1/1967 Cornelius ..... 206/144
D210,930 S * 5/1968 Box ..... D3/309
D237,686 S * 11/1975 Torokvei ..... D3/309
3,991,879 A * 11/1976 Hirota ..... 206/203
D280,773 S * 9/1985 Addy et al. ..... D3/309
4,858,444 A 8/1989 Scott
4,899,553 A 2/1990 Drummond, III
5,080,240 A 1/1992 Williams
D330,513 S * 10/1992 Gilchrist ..... D3/309
5,378,433 A 1/1995 Duckett et al.
D382,711 S * 8/1997 Wyman ..... D3/309
5,702,140 A * 12/1997 Radja ..... 294/146
5,857,570 A 1/1999 Brown
D405,006 S * 2/1999 Spencer ..... D9/753
5,871,106 A 2/1999 Oksa et al.
6,065,303 A 5/2000 Harris
6,102,215 A 8/2000 Guida
6,802,802 B2 10/2004 Wong
6,832,797 B1 12/2004 Gassel et al.

* cited by examiner

*Primary Examiner*—Paul T Chin
(74) *Attorney, Agent, or Firm*—Black Lowe & Graham, PLLC

(57) ABSTRACT

A caulk carrying device includes a plurality of compartments for holding tubes of caulk, a handle, and a cavity for receiving and holding a caulk gun. Preferably integrally molded from plastic, the carrying device may include a projection for piercing tubes of caulk and bores in the compartments that are centrally located to facilitate stacking of multiple carrying devices.

13 Claims, 3 Drawing Sheets

CAULK CADDY

PRIORITY CLAIM

This application claims the benefit of prior provisional application Ser. No. 60/851,268, filed Oct. 13, 2006, which is hereby incorporated by reference.

FIELD OF THE INVENTION

This invention relates generally to devices for carrying caulk tubes and related accessories.

BACKGROUND OF THE INVENTION

In many building construction or other settings, there is a need for a significant amount of caulk. Generally sold in tubes, caulk can be awkward to carry from place to place around a jobsite. It can also be messy and extremely difficult to remove when caulk accidentally comes in contact with unintended surfaces.

Some within the industry have tried to solve this problem, but with unsatisfactory results. For example, Guida describes a device in U.S. Pat. No. 6,102,215 in which a panel is mounted to a wall to hold several tubes of caulk and a caulk gun. The device is not transportable, however, and fails to address the fundamental concerns at issue with this invention.

Gassel, et al. describes a caulk tube carrier in their U.S. Pat. No. 6,832,797. In the Gassel carrier, several tubes of caulk are wedged within a frame so that it can be carried about a worksite. The Gassel device is limited in several respects, such as the inability to accommodate a caulk gun, the difficulty in removing tubes, and the instability of the device when loaded with caulk. These and other prior efforts have tried but failed to produce a suitable device.

SUMMARY OF THE INVENTION

The preferred caulk carrying device is a portable container designed for transporting and storing multiple tubes of commercially available caulk. It is configured to hold new and used caulk tubes in an organized manner allowing the user to easily locate and retrieve a desired tube of caulk.

As caulk presently is sold in tubes of different sizes, various forms of this invention are sized to accommodate different caulk tube sizes. Two distinct sizes are presently most common, including a smaller tube that is approximately one and seven-eights inches in diameter and a larger tube that is approximately 3¼" in diameter. Yet, other tube sizes are possible, and the dimensions of the invention as described below may likewise be adjusted to fit tubes of different sizes.

The preferred caulk carrying device is formed from plastic material that is molded into a generally rectangular shaped container. The base consists of a number of separate, cylindrically shaped compartments designed with flat bases with a hole in the center of each base to accommodate water drainage and allow fully loaded caddies to be stacked with the tips of caulk tubes lodged in the caddy stacked upon it. Each compartment is designed to hold a caulk tube in an upright position. The compartments are arranged in two rows with a separation between the two rows to hold a caulk gun. A U-shaped cut out in one end of the compartment receives the caulk gun's handle. The caulk gun can be inserted into the container at an angle to keep the weight of the cartridge at the bottom and to help secure the gun in place. An opening at the opposing side of the handle opening allows long caulk tube tips to extend out of the container. A metal stud insert located above this opening and would function as a puncture tool for new caulk tubes.

The center portion of caddy is equipped with a handle extending upward. A small compartment in the caddy between the puncture tool and the handle can hold several caulk tube caps or other small items.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
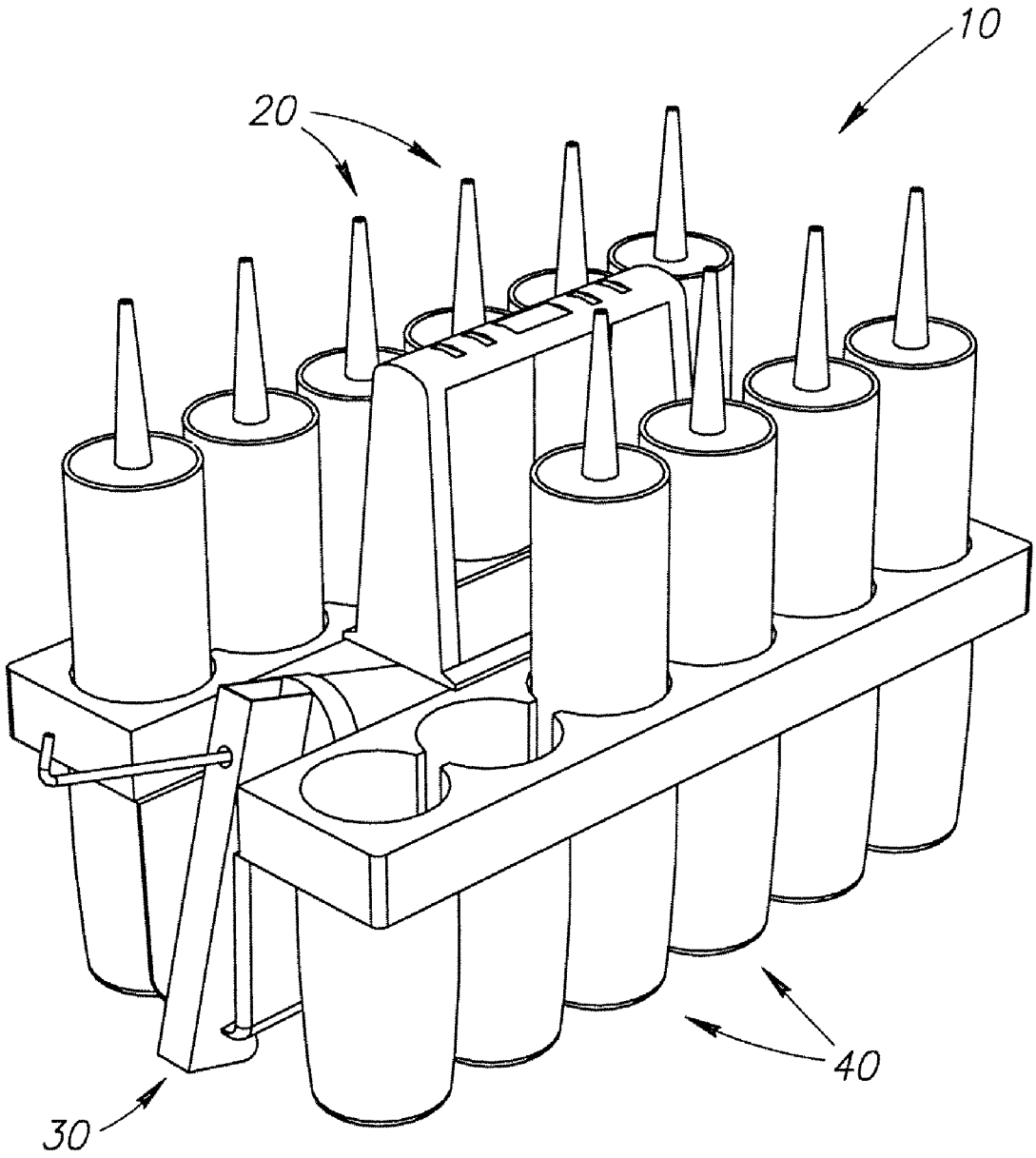
FIG. 1 is a perspective view of a preferred caulk caddy, shown with exemplary tubes of caulk and a caulk gun in place.

FIG. 1 shows a preferred caulk caddy, or caulk carrying device 10. In the perspective view of FIG. 1, the carrying device is shown with several tubes of caulk 20 and a caulk gun 30 in place.

In the configuration as shown, the carrying device includes twelve substantially cylindrical compartments 40, each being sized and shaped to receive a tube of caulk 20. Though the compartments are preferably cylindrical, they may also be slightly narrower at the bottom than at the top to hold the tubes firmly in place while facilitating easy removal. Although twelve compartments are shown in the example of FIG. 1, a greater or smaller number of compartments may be provided, consistent with the invention. Likewise, the tube compartments 40 as shown are all substantially the same size in the version of FIG. 1. In alternate examples, the caddy 10 may have one or more compartments sized to receive a first caulk tube size and one or more compartments sized to receive a second, larger caulk tube size. These different compartment sizes may be arranged in alternating fashion or may be grouped on different sides of the caddy, for example.

The caddy 10 is preferably produced from a durable plastic material. Thermoplastics such as polyethylene, polypropylene, and other similar thermoplastic materials are acceptable choices, although other materials are also suitable. Members of this family are recognized universally as being versatile and of high quality. The benefits of using thermoplastic materials are that they have a wide range of qualities. They may be lightweight but extremely durable, rigid or flexible, opaque, or transparent, resistant to heat and chemicals, and unyielding or springy. The invention is not limited to material choices for the construction of the caddy, however, which may also be constructed from wood, metal, or other materials.

Current caulk tubes are commercially sold in two primary sizes, and therefore preferred embodiments of the invention are configured to accommodate these sizes. One such tube holds approximately a quart of caulk and measures 2¾ inches in diameter, twelve inches from the bottom to the top of the tube, and an additional four inches for the tip. A smaller commercial tube measures about two inches in diameter, just over eleven inches in height, and a tip of about 2¾ inches. Although the invention is not constrained to particular tube sizes and may be made to accommodate these or other sizes of caulk tubes, preferred versions of the invention are configured to accept commercially available tube sizes.

Figure 2:
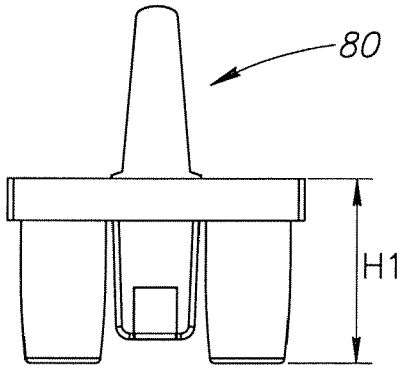
FIG. 2 is an end view of the caulk caddy of FIG. 1.
Figure 3:
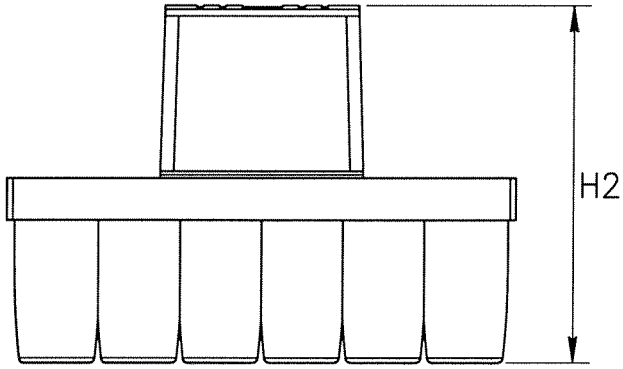
FIG. 3 is a side view of the caulk caddy of FIG. 1.
Figure 4:
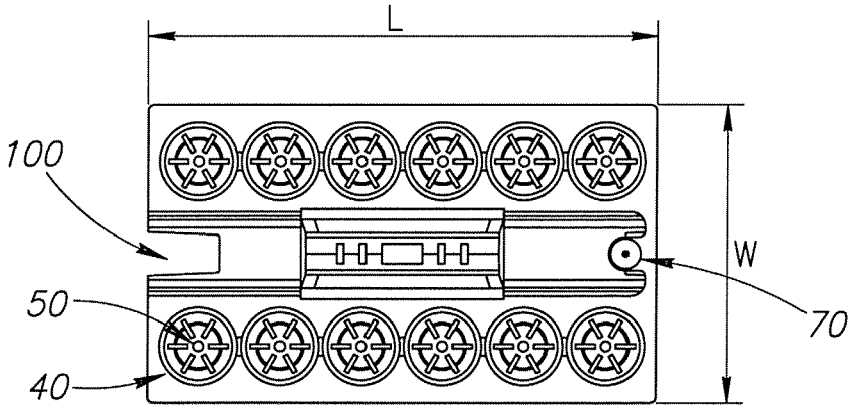
FIG. 4 is a top view of the caulk caddy of FIG. 1.

As best seen in FIGS. 2-4, the caulk caddy is preferably generally rectangular in shape, having a length l, width w, height of the compartment portion, or base, h1, and overall height to the top of the handle, h2. Based on the currently predominant caulk tube sizes, one version of the invention measures approximately five and one-half inches in height h1, 14¾" in length l, and nine inches in width w.

As illustrated in FIG. 4, each of the compartments 40 includes a base reinforced with a plurality of radially extending flanges. At substantially the center of the base of the compartment is a hole 50. The hole is configured to allow water or other such materials to drain from the bottom of the compartment. In addition, the holes in the compartments are sized and shaped to allow multiple caddies that are loaded with caulk to be stacked atop one another. The dimension of the holes 50 is somewhat larger than the narrowest portion of the tip if a tube of caulk but smaller than the widest portion of the tip of a tube of caulk. Accordingly, a tip of a caulk tube can be inserted only partially into the hole 50. Thus, a first caddy 10 may rest on top of a second caddy 10, in which the tips of the tubes of caulk from the second caddy are inserted into the holes 50 of the compartments 40 of the first caddy.

Figure 5:
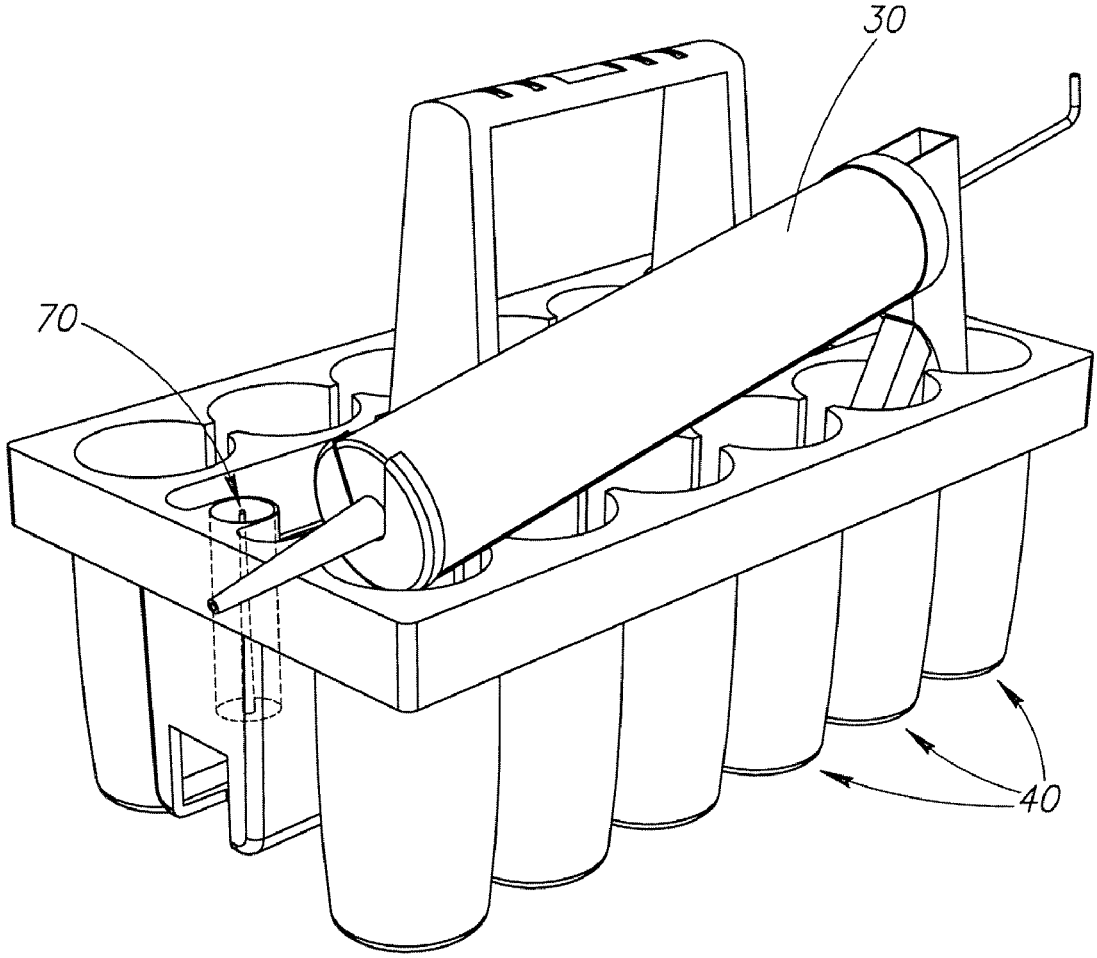
FIG. 5 is a perspective view of the caulk caddy of FIG. 1, shown without caulk tubes in place.

The caddy 10 further includes a projection 70 that serves as a tip puncturing device. The projection 70 is preferably constructed in the form of a metal spike or nail embedded into the plastic forming the caddy 10. As best seen in FIG. 5 (with a portion of the base being shown in phantom to better reveal the projection), the projection 70 is housed within a cavity that is sized to receive the tip of a caulk tube. Likewise, the projection is formed such that it is long enough to extend sufficiently into a tube of caulk to puncture the seal within the cylinder of caulk. As shown, the projection 70 is located at one end of the caddy 10, extending generally upward from the base. It may alternatively be located in other places, and may extend horizontally, at an angle, or in different configurations. In addition, the rim of the cavity is either flush with or slightly higher than the tip of the projection 70 so that users of the caddy will not accidentally cut themselves or other objects on the tip of the projection. Accordingly, the cavity is preferably defined as a cylinder that terminates with a top surface of the caddy that is generally coplanar with the top surface of the compartments 40 as described above.

As shown in FIG. 1, in one version the caddy is configured with a first set of compartments on a first side of the caddy and a second set of compartments on a second side of the caddy. As shown, there are six compartments in each set, for a total of twelve overall. A greater or smaller number of compartments may be used. Likewise, each of the two sets of compartments need not be the same in number or size and configuration. Still further, in other optional embodiments there are additional sets or one group of compartments arranged in a circular or other pattern.

A handle 80 extends upward from the caddy at a location between the two sets of compartments, overlying the intermediate space between the sets or rows of compartments. Most preferably, the height of the handle is somewhat below the height of the tips of tubes of caulk when inserted into the compartment so that multiple caddies can be stacked atop one another as described above.

A central cavity or slot 100 is provided in an intermediate space between the sets of compartments and is open at one end of the caddy 10, preferably the end opposite the location of the projection 70. The slot 100 is configured to receive a caulk gun, whether loaded with a tube of caulk or empty. The slot is preferably oriented in a slightly angular fashion so that the tip of the caulk gun is below the handle of the caulk gun. In addition, the overall length of the caddy is such that the slot 100 can fully receive the caulk gun while leaving the handle of the caulk gun exposed for easy access. In an alternate form, the intermediate space may comprise a shelf or similar platform configured to support a caulk gun.

As a further feature of the preferred form of the invention, a caulk gun can rest atop a set of compartments (with the compartments empty). As shown in FIG. 5, the aligned set of compartments 40 is sufficiently long and unobstructed that a caulk gun 30 can be placed on top of and partially within the compartments. The front end of the caulk gun rests within one compartment while the trigger and base portions of the handle rest within two additional compartments, thereby holding the caulk tip above the floor, countertop, or other such surface.

The caulk caddy as described above is extremely easy to use. The user simply loads the compartments with the desired types of caulk tubes and inserts the caulk gun. The user then grasps the handle to easily lift and carry the caddy to the desired work site.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A carrier for holding a plurality of tubes of caulk, comprising:

a carrier body formed with a plurality of compartments, each of the compartments being configured to receive one of the plurality of tubes of caulk;

a cavity formed within the carrier body, the cavity being sized and arranged to hold a caulk gun; and a handle attached to the carrier;

wherein the plurality of compartments comprises a first set of compartments arranged in a first row on a first side of the handle and a second set of compartments arranged in a second row on a second side of the handle, each of the first row and the second row having a lower surface and an upper rim defining a height;

further wherein the cavity is formed in the space directly beneath the handle and between the first row and the second row, the cavity having a floor configured to support the caulk gun, the floor being relatively higher than the lower surfaces of the first row and the second row.

2. The carrier of claim 1, wherein each of the compartments is substantially circular in cross-section.

3. The carrier of claim 1, wherein the first plurality of compartments comprises six compartments and the second set of compartments comprises six compartments.

4. The carrier of claim 1, further comprising a projection for piercing one of the tubes of caulk.

5. The carrier of claim 4, wherein the projection includes a sharpened tip and is housed within a cavity having a rim, the tip of the projection being within the cavity at a location below the rim.

6. The carrier of claim 1, wherein each of the compartments includes a base having a central bore, the central bore being configured to receive a tip of a tube of caulk.

7. The carrier of claim 1, wherein each of the compartments comprises a diameter, the diameter of each of the compartments being substantially the same.

8. The carrier of claim 1, wherein each of the compartments comprises a diameter, wherein the diameter of at least one of the compartments is smaller than the diameter of at least one other of the compartments.

9. The carrier of claim 1, further comprising a first height defined by a top surface of a tube of caulk when housed within a compartment, and a second height defined by a top surface of the handle, wherein the first height is greater than the second height.

10. A carrier for holding a plurality of tubes of caulk, comprising:

a carrier body formed with a plurality of substantially cylindrical compartments, each of the compartments having a lower surface and an upper rim defining a height and being configured to receive one of the plurality of tubes of caulk, the plurality of compartments further being arranged into a first set of compartments and a second set of compartments, the first and second sets of compartments being separated by an intermediate space;

a shelf formed on the carrier body, the shelf being located in the intermediate space and configured to hold a caulk gun; the shelf being located at a level between the lower surface and the upper rim, the shelf further having a width between the first set of compartments and the second set of compartments; and a handle attached to the carrier, the handle extending upwardly and overlying the intermediate space at a position that bifurcates the width of the shelf.

11. The carrier of claim 10, further comprising a means for piercing one of the tubes of caulk.

12. The carrier of claim 10, wherein each of the compartments includes a base having a central bore.

13. The carrier of claim 10, wherein each of the compartments further comprises a diameter, the diameter of at least one of the compartments being smaller than the diameter of at least one other of the compartments.

* * * * *